United States Patent [19]

Barroero

[11] Patent Number: 4,692,963

[45] Date of Patent: Sep. 15, 1987

[54] SELF-CLOSING HINGE AND ISOLATION DOOR INSTALLATION

[76] Inventor: Louis F. Barroero, 1585 Daniels Dr., San Leandro, Calif. 94577

[21] Appl. No.: 874,507

[22] Filed: Jun. 16, 1986

Related U.S. Application Data

[63] Continuation-in-part of Ser. No. 689,337, Jan. 7, 1985, abandoned.

[51] Int. Cl.[4] ..... E05F 1/14

[52] U.S. Cl. ..... 16/275; 16/284; 16/285; 16/301; 16/315

[58] Field of Search ..... 16/273, 275, 284, 285, 16/299, 300, 301, 313, 314, 315, 316, 317, 318, DIG. 27

[56] References Cited

U.S. PATENT DOCUMENTS

| | | | |
|---|---|---|---|
| 923,400 | 6/1909 | Ahlvin | 16/284 |
| 1,056,171 | 3/1913 | Henry | 16/284 X |
| 2,718,026 | 9/1955 | Slopa et al. | 16/313 |
| 2,747,238 | 5/1956 | Jones et al. | 16/313 X |
| 3,160,913 | 12/1964 | Carey | 16/315 |

*Primary Examiner*—Fred Silverberg

*Attorney, Agent, or Firm*—Matthews & Associates

[57] ABSTRACT

A self-closing isolation door installation adapted to swing between a closed and an open position. A resilient gasket is connected about the periphery of the door to insure a tight seal. The door has a rotatable first hinge vertically mounted and adapted for mounting to the side of a door frame. A second self-closing hinge is provided including an elongated C-shaped bracket mounted into the edge of the door. The C-shaped bracket includes a vertical support strut, upper arm and lower arm. A support shaft is vertically fixed between the upper arm and the lower arm. A housing bracket is mounted to the shaft and is adapted for mounting to the side of the door frame. The housing bracket defines an inverted V-shaped cam surface. A cam follower including a radially spaced apart inner follower roller and an outer follower roller is mounted around the shaft with the outer roller adapted for vertical movement within a slot in the strut and the inner roller is engageable to follow the cam surface. A compression spring mounted around the shaft biases the follower body to bias the inner roller against the V-shaped cam surface and thereby to apply closing force to the door through the outer roller within the slot to rotate the C-shaped bracket and the door.

10 Claims, 8 Drawing Figures

SELF-CLOSING HINGE AND ISOLATION DOOR INSTALLATION

This application is a continuation-in-part of application Ser. No. 689,337, filed Jan. 7, 1985, and now abandoned.

FIELD OF THE INVENTION

This invention pertains to an improved self-closing door hinge and an installation for maintaining environmental conditions.

BACKGROUND OF THE INVENTION

Many industrial and specialized facilities utilize rooms or chambers where specific environmental conditions must be closely maintained. For example, hospital surgical rooms require a sterile environment. Semiconductor wafer fabrication facilities need to maintain clean rooms. Industrial facilities require certain temperatures which must be maintained for certain processes or to prevent product deterioration.

In all of these situations, there must be entry and exit facilities. Typically, such entry and exit facilities include doors for both vehicular and foot traffic.

Such doors are designed to swing open by pushing an object such as a forklift, gurney, or a person's hand against the door. The door must have means for being returned to the closed position without further attention.

A typical prior art approach includes a door hinge having a V-shaped cam with the apex of the "V" centered at the closed position. A follower mounted on the door rests on the V-shaped cam so that, when the door is pushed open, the follower rides up the V. When the force applied against the door is removed, gravity causes the follower to ride back down the V, thereby shutting the door.

A readily apparent disadvantage of this type of door assembly is that the door undergoes vertical motion equivalent to the rise of the cam. If the door is to be sealed, the use of a large gasket seal at the top and bottom of the doors is required. The weight of such a door rests directly on the cam and follower, rather than on a bearing which would allow for smoother and more even operation of the door.

Presently known prior art includes the following:

U.S. Pat. No. 4,080,374 to Brown
U.S. Pat. No. 4,045,913 to Wright
U.S. Pat. No. 1,408,302 to Kelly
U.S. Pat. No. 3,059,298 to Baruch, et al.
U.S. Pat. No. 1,578,328 to Lessing
U.S. Pat. No. 1,556,091 to Edwards
U.S. Pat. No. 2,718,026 to Slopa, et al.
U.S. Pat. No. 2,747,238 to Jones, et al.
U.S. Pat. No. 3,160,913 to Carey
U.S. Pat. No. 1,056,171 to Henrey
U.S. Pat. No. 923,400 to Ahlvin

OBJECTS OF THE INVENTION

It is an object of the present invention to provide a self-closing door installation which effects a positive seal for maintaining controlled environmental conditions.

It is another object of the present invention to provide a self-closing door hinge as part of the installation which improves the energy efficiency of the door by reducing the amount of gasketing necessary to effect the seal.

It is yet another object of the present invention to provide a self-closing door installation which positively returns to a precise closed position and which may be adjusted to require varying amounts of force to open the door.

It is a further object of the invention to provide a self-closing door hinge wherein a single large capacity low friction bearing may support the entire weight of the door rather than a cam surface.

SUMMARY OF THE PRESENT INVENTION

The foregoing and other objects are attained by a self-closing isolation door installation featuring a door mounted in sealed relation within a door frame and adapted to swing between a closed and an open position. A resilient gasket is connected about the periphery of the door to insure a tight seal in the open spaces around the edge of the door. A first hinge is vertically mounted with the side edge of the door and adapted for mounting to the side of the vertical member of the door frame. A second self-closing hinge including, a flanged, C-shaped bracket is mounted into the side edge of the door and onto the surfaces of the door with the flange being U-shaped. The bracket includes a vertical support strut defining a vertical slot, an upper arm, and a lower arm. A support shaft is mounted vertically in fixed relation between the upper arm and the lower arm. A housing bracket is mounted in pivotable relation around the shaft to vertically support the upper arm and is adapted for mounting to the vertical side of the door frame. A rotary roller bearing may be disposed on the shaft between the upper arm and the housing bracket which may support the entire weight of the door as appropriate. The housing bracket defines an inverted V-shaped oam surface around the shaft with the top or apex of the V-shape being oriented with the width of the door when the door is in closed position. A cam follower body including a follower arm carries a radially spaced apart inner follower roller and outer follower roller. The follower arm body is mounted in pivotable relation around the shaft with the outer roller engaged for vertical movement within the slot and the inner roller being engageable to follow the cam surface responsive to relative rotation between the door and the housing bracket. A resilient compression spring is mounted around the shaft and biases the follower body to bias the inner roller against the V-shaped cam surface toward the closed position of the door.

The installation is operable, when the door has force applied to pivot the door and the bracket about the shaft from a closed position toward an open position, for the outer roller to pivot the follower body along with the door with the inner roller moving the follower body down and further compressing the spring. The compression of the spring then causes the door to return to closed position when the force is removed.

IN THE DRAWING

DESCRIPTION OF A PREFERRED EMBODIMENT

Figure 1:
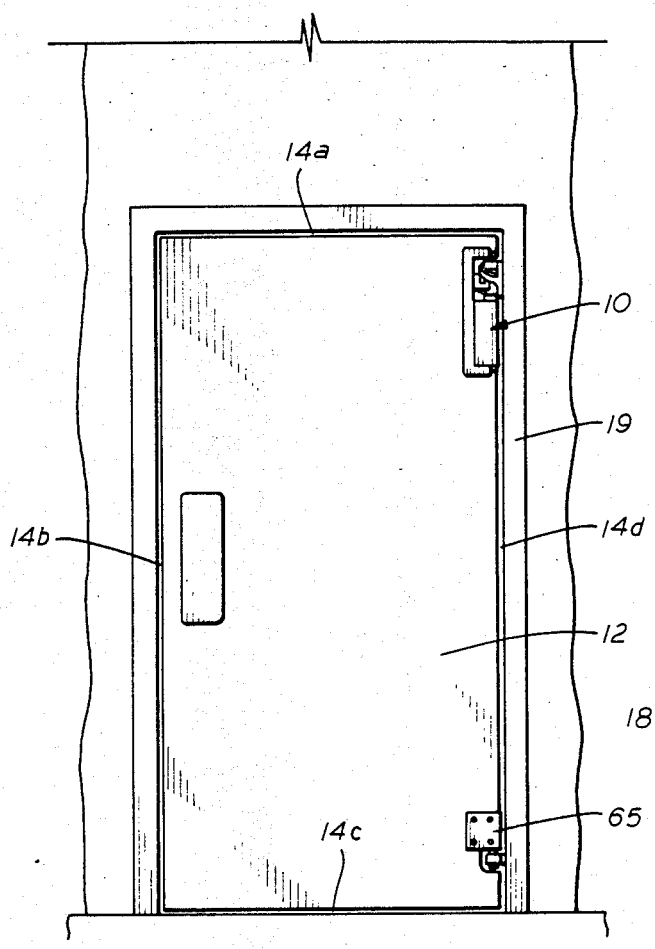
FIG. 1 is an elevational view illustrating a door installation with the self-closing door hinge of the present invention.

FIG. 1 illustrates a self-closing door hinge 10 fitted within a door structure 12. The door 12 is seen to have a gasket 14 including 14*a*, 14*b*, 14*c* and 14 mounted around the periphery to insure that the door is sealed within the frame or jam 19. Gasket 14 is flexible and may be formed of any resilient rubber or plastic. A larger size opening may have two such doors 12 (not shown) mounted from opposite sides of the jam 19 and meeting in the center with the respective gaskets 14*b* touching or slightly overlapping to effect a seal.

Figure 2:
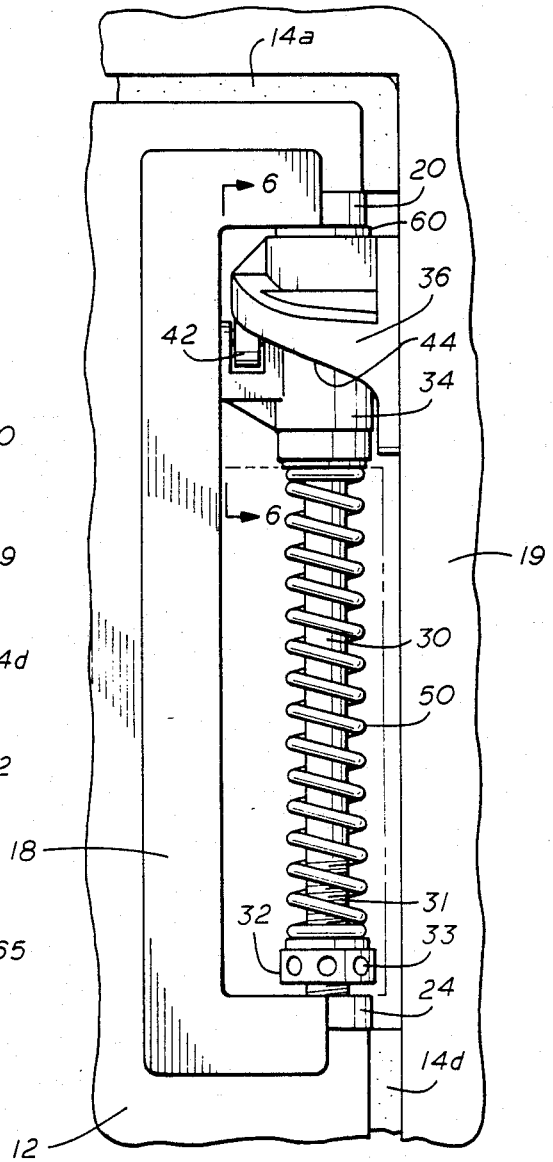
FIG. 2 is an elevational view showing the self-closing hinge of FIG. 1 in greater detail.
Figure 3:
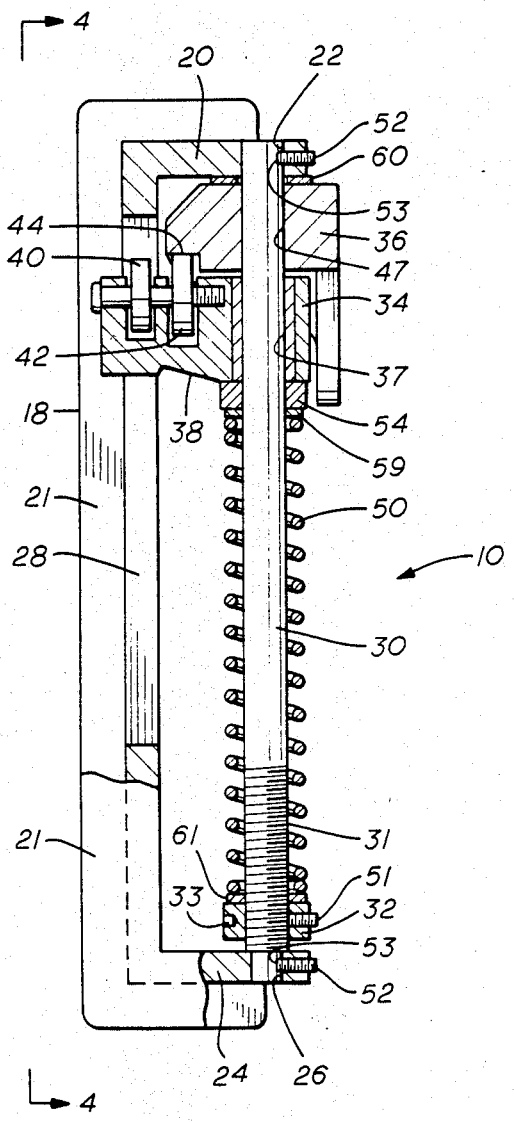
FIG. 3 is an elevational, parially sectional, view of the self-closing hinge of FIG. 2.
Figure 4:
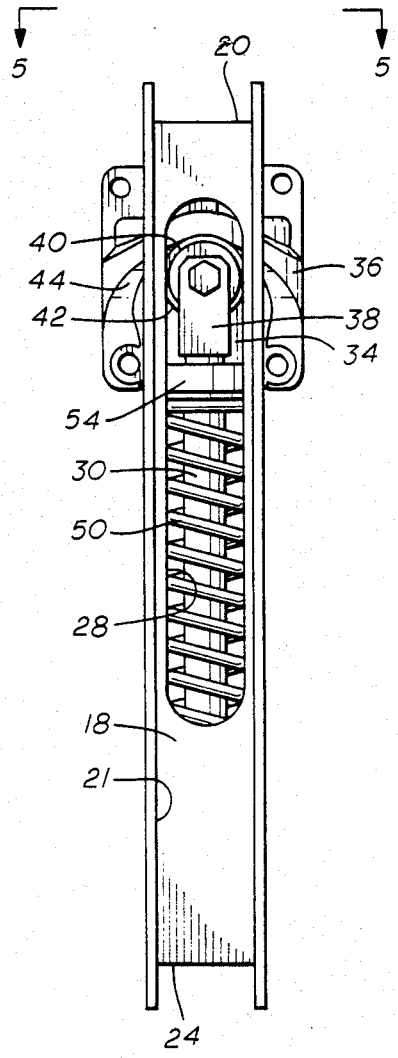
FIG. 4 is an elevational view taken along the line 4—4 of FIG. 3.
Figure 5:
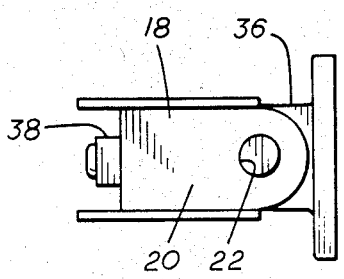
FIG. 5 is a top plan view of he self-closing hinge of FIG. 3 taken along the line 5—5 of FIG. 4.

The self-closing hinge 10 is better shown in FIG. 2 with its constituent components best shown in FIG. 3. The hinge 10 includes a door bracket 18 having the shape of an elongated "C" which is adapted to be mounted within a recess in the side of the lateral edge of the door 12 opposite a door jam 19. As shown in FIGS. 4 and 5, the bracket 18 is of U-shape extending around the outer edge of the C-shape with the door surfaces fitting into the U-cavity 21 of the bracket 18.

The bracket 18 includes an upper ledge 20 into which is formed a hole 22 and a lower ledge 24 into which is formed a hole 26. The upper and lower ledges 20 and 24 are disposed in parallel and the holes 22 and 26 are axially aligned. Also formed into the upright portion of the bracket 18 is a vertical slot 28.

A cylindrical shaft 30 is mounted through the holes 26 and 22 and is installed by inserting the shaft 30 through the top hole 22 down into the hole 26 with the other components being mounted on the shaft between ledges 24 and 20 as shown. It is seen that the shaft 30 and the bracket 18 form a rectangular shaped assembly adapted to be rotated about the shaft 18.

A lower portion of the shaft 30 includes screw threads 31 over which an adjustment sleeve 32 is threaded as shown. A plurality of holes 33 are formed part way into the sleeve 32 which are adapted to receive a lever or a "spanner" wrench by which the sleeve 32 may be rotated around the shaft 30.

A roller assembly 34 and a support housing bracket 36 are rotatably mounted on the shaft 30 with shaft 30 extending through a hole 37 formed in the roller assembly and a hole 47 formed in the housing bracket.

Figure 6:
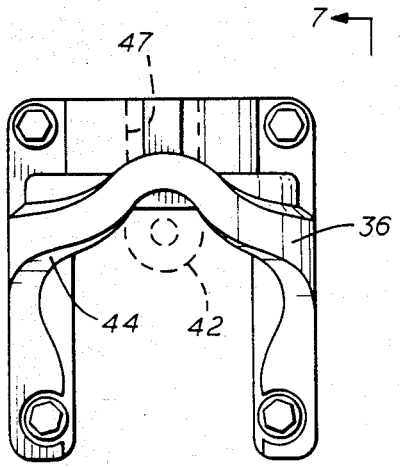
FIG. 6 is an elevational view of the support bracket of FIG. 2 as seen from the line 6—6 of FIG. 2.
Figure 7:
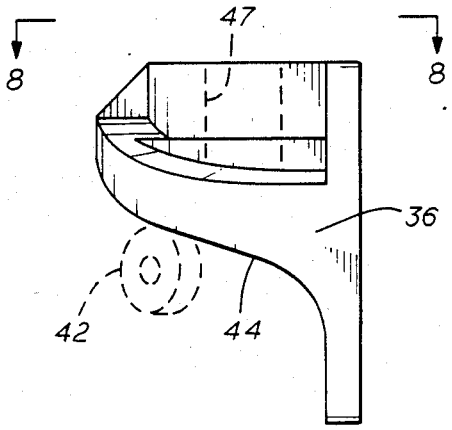
FIG. 7 is an elevational view taken along the line 7—7 of FIG. 6.
Figure 8:
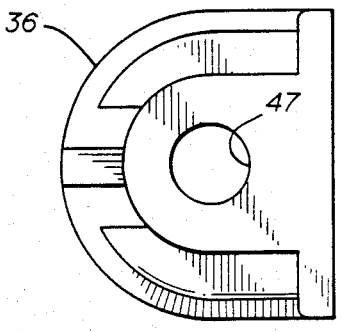
FIG. 8 is an elevational view taken along the line 8—8 of FIG. 7.

The housing bracket 36 which is better illustrated in FIGS. 6–8, includes a V-shaped surface of a cam 44 which is oriented inwardly toward the base 46 of the bracket 18 as shown in FIGS. 2 and 3. Surface 44 is formed as an inverted V extending around the hole 47 and having its apex aligned at 90° with the plane of the door jam 19.

An actuating arm 38 extends horizontally from the roller assembly 34 at 90° from the hole 37. A first follower roller 40 and a second follower roller 42 are rotatably mounted along an upper surface of the arm 38 such that the roller 42 rides on the surface of the cam 44 of bracket 46 and the roller 40 is extended into the slot 28 and is guided through perpendicular movement by the walls of the slot 28.

Also mounted between the upper ledge 20 and the lower ledge 24, along the shaft 30, are a heavy duty low friction bearing 60 mounted between the bracket 46 and the lower side of the ledge 20, spring bearings 54 and 59 mounted below the support roller assembly 34 and above a spring 50, and a washer 61 mounted between the spring 50 and the adjustment sleeve 32 which completes the assembly such as shown in FIG. 3.

The upper bearing 60, when mounted as shown in FIGS. 2 and 3, may bear the entire weight of the door and is desirably provided as a roller type bearing. The bearing 54 is preferably bronze or other suitable low friction material and provides smooth rotation of the roller assembly 34 with respect to the spring 50 and bearing 59 without the "twitching" usually found when a spring frictionally binds against a load which is being rotated about one of its ends.

The spring 50 applies compressional force to the roller assembly 34 such that the second follower 42 is firmly forced against the surface 44 to insure accurate tracking of the follower roller 42 against the cam surface 44. The spring 50, which biases the roller assembly 34 against the cam surface 44, provides the compressive force operating to return the door 12 to a closed position from any position other than the closed position.

The compressional force of the spring 50, as transmitted by the follower roller 42 against the cam surface 44, is controlled by adjusting the threaded adjustment sleeve 32. A heavier door 12 would require more tension on spring 50 and perhaps even a heavier spring 50.

The shaft 30 is locked into the upper ledge 20 and the lower ledge 24 by set screws 52 which extend through threaded holes against the shaft 30 as shown. Holes 53 may be formed in the upper and lower ends of the shaft 30 to receive the set screws 52 if desired. The bronze bearing 54 may be extended with a reduced diameter from below the member 34 up through the member 34 to provide a lateral bearing on the member 34 as it rotated about the shaft 30 as shown in FIG. 3.

Since the door 12 is supported by the bracket 18, and its upper arm or ledge 20 in particular, the weight of the entire door 12 may rest wholly atop the bearing 60 and be supported by bearing 60.

Any remaining weight of the door 12 may be supported by an ordinary swinging door hinge assembly 65 of the prior art which is secured to the door 12 and door jam 19 at the lower edge of the door 12. The bearings 60 and 54 and the lower hinge assembly 65 provide for low frictional operation of the installation 12 such that low amounts of force are necessary to push the door 12 open.

OPERATION OF THE INSTALLATION

Referring now to FIGS. 1, 2, 3 and 6, operation of the installation 10 is as follows:

In the closed position, the second follower roller 42 is located at the apex of the "V" of the cam surface 44 and the door 12 rests with the gasket 14 extendng around the door and against door jam 19, or against a second door (not shown) if the opening is sufficiently wide to need an opposed door.

When movement from room to room is necessary, the door 12 is opened by pushing against the side panels, either manually or with a rolling piece of equipment. The follower 42, as shown in FIG. 3, is forced out of the apex of the V and follows along the V-shaped cam surface 44. This motion serves to compress further the spring 50 which exerts compression force upwardly against the follower roller 42. The least spring compression is exerted when the follower 42 is at the apex of the "V" surface 44. The greatest compression occurs when the follower roller 42 is at either end of the "V" surface 44.

Simultaneously, the follower roller 40 rides down within the slot 28 and thereby rotates the member 34 about the shaft 30, causing the follower roller 42 to ride from the apex down the sides of the V surface of surface 44.

It is to be noted in reference to FIGS. 2, 3, 6 and 7, that the door 12 may be opened a full 90° or more from the closed position in either direction. This movement can be greater or lesser depending on the length of the curved surface 44 and the location of the axis of the shaft 50 with respect to the lower ends of the curve 44.

When pressure against the door 12 is released, the compression of the spring 50 forces the roller assembly 34 and roller 42 against the curved surface 44 and the follower roller 42 is forced to travel to the apex of the V.

As the follower roller 42 is urged upwardly into the apex of the V-shaped surface 44, the other follower roller is guided up within the slot 28 while exerting force against one of the sides of the slot and thereby urge the door toward the closed position as determined by the apex of the V of the surface 44.

When the follower roller 42 has reached the apex of the V as described, then the follower roller 40 has urged the door into the closed position.

It is to be noted that the door 12 swings from closed to opened to closed in either direction with no vertical movement. All vertical movement in this articulation is made by the roller assembly 34 against the spring 50 as the roller assembly 34 is guided by the cam roller 42 and the slot roller 40 through the arm 38 as attached to the roller assembly 34. This structure facilitates the provision of the insulation around the door 12 in the form of the gasket 14 which could not be used as shown if the door 12 also had vertical movement during its horizontal movement.

It is to be noted that the single embodiment of the invention as herein illustrated and described may be changed substantially as appropriate for particular installations and circumstances, with all such changes remaining within the scope and purview of the appended claims.

What is claimed:

1. In a self-closing isolation door installation, the combination comprising:

(a) a door adapted for mounting within a door frame and adapted to swing between a closed and an opened position;

(b) resilient gasket means connected about the periphery of said door to insure a tight seal in open spaces about said door;

(c) a first hinge means vertically mounted with the side edge of said door and adapted for mounting to the side of a vertical member of said door frame;

(d) a second self-closing hinge means including a vertically disposed, elongated C-shaped bracket slidably mounted into said side edge of said door;

(e) said bracket including vertical strut, an upper arm, and a lower arm;

(f) a support shaft mounted in fixed relation between said upper arm and said lower arm to complete a structure which is generally rectangular in shape;

(g) a housing bracket mounted in pivotable relation around said shaft and closely adjacent to said upper arm to vertically support said upper arm and adapted for mounting to said vertical side of said door frame and thereby to support said door from said door frame as appropriate;

(h) said housing bracket defining an inverted V-shaped cam surface extending radially around said shaft with the apex of said V-shape being oriented with said door when said door is in said closed position;

(i) a cam follower body including a follower arm carrying a radially spaced apart inner follower roller and outer follower roller, (1) said follower body being mounted in pivotable relation around said shaft with said outer roller engaged for vertical movement within said slot, and (2) said inner roller being engageable to follow said cam surface responsive to relative rotation between said door and said housing bracket; and (j) resilient compression spring means mounted around said shaft and biasing said follower body to forcefully bias said inner follower roller against said V-shaped cam surface; a rotary bearing mounted on said shaft between said upper arm and said housing bracket and adapted to support the entire weight of said door; said vertical strut, said upper arm and said lower arm are formed with a linear outwardly facing U-shape slidably fitting over the sides of the door and against the side edge of said door.

2. The combination of claim 1 wherein said combination is operable, when mounted in the door frame with said door having force applied, to allow said door and said follower body to pivot from said closed position toward an open position with said outer follower roller pivoting said follower body along with said door and with said inner roller moving said roller follower body down to further compress said spring, the compressive force of said spring then causing said door to return to said closed position when said force is removed.

3. The combination of claim 1 wherein said rotary bearing is a roller bearing.

4. The combination of claim 3 further including a rotary bearing mounted between said cam follower body and said resilient spring means.

5. The combination of claim 4 further including a sleeve in threaded connection on said shaft between said lower arm and said resilient spring for adjustment of the compressional bias of said spring.

6. The combination of claim 1 wherein said first hinge means is mounted close to the bottom of said door and said second self-closing hinge means is mounted close to the top of said door.

7. In self-closing door hinge apparatus, the combination comprising:

(a) an elongated C-shaped bracket adapted for mounting in the side edge of a door;

(b) said bracket including a vertical support strut having a vertical slot defined therein, an upper arm, and a lower arm;

(c) said vertical strut, said upper arm and said lower arm having a linear outwardly facing U-shape adapted to slidably fit over the sides of the door and against the side edge of a door;

(d) a support shaft vertically mounted in fixed relation between said upper arm and said lower arm;

(e) a housing bracket mounted in pivotable relation around said shaft to vertically support said upper arm and adapted for mounting to the vertical side of a door frame and thereby to carry the full weight of a door;

(f) said housing bracket defining a cam surface of inverted V-shape extending around said shaft;

(g) a cam follower body including a follower arm carrying a radially spaced apart inner follower roller and an outer follower roller, said follower body mounted in pivotable relation around said shaft with said outer roller engaged for a vertical movement within said slot and said inner roller being engageable to follow said cam surface responsive to relative location between said strut and said housing brackets;

(h) resilient compressional spring means mounted around said shaft and biasing said follower body to bias said inner roller against said cam surface with the apex of said V-shape being aligned to where said vertical strut maintains a door in a closed position; and (i) said combination being operable, when mounted in a door frame with the door having force applied to pivot said bracket about said shaft from said closed position toward an open position, for said outer follower to pivot said follower body along with said door and with said inner roller moving said follower body down and further compressing said spring, the compressive force of said spring then causing said door to return to said closed position when said force is removed; a rotary bearing mounted on said shaft between said upper arm and said housing bracket and adapted to carry the weight of a door.

8. The combination of claim 7 wherein said rotary bearing is a roller bearing.

9. The combination of claim 8 further including a rotary bearing between said cam follower body and said resilient spring means.

10. The combination of claim 7 further including an adjustment sleeve in threaded connection on said shaft between said lower arm and said resilient spring for adjustment of the compressional bias of said spring.

* * * * *